US011864640B2

(12) United States Patent
Rickards et al.

(10) Patent No.: US 11,864,640 B2
(45) Date of Patent: Jan. 9, 2024

(54) BI-AXIAL BALL TIP FOR USE WITH A MOBILITY CANE

(71) Applicant: INVENTRICK PTY LTD, Nunawading (AU)

(72) Inventors: Peter Rickards, Nunawading (AU); Rohan Rickards, Nunawading (AU)

(73) Assignee: INVENTRICK PTY LTD, Ringwood (AU)

( * ) Notice: Subject to any disclaimer, the term of this patent is extended or adjusted under 35 U.S.C. 154(b) by 0 days.

(21) Appl. No.: 17/378,834

(22) Filed: Jul. 19, 2021

(65) Prior Publication Data

US 2023/0016090 A1 Jan. 19, 2023

(51) Int. Cl.

| | |
|---|---|
| ***A45B 9/04*** | (2006.01) |
| ***A45B 1/04*** | (2006.01) |
| *A45B 9/00* | (2006.01) |

(52) U.S. Cl.

CPC ..... *A45B 9/04* (2013.01); *A45B 1/04* (2013.01); *A45B 2009/007* (2013.01)

(58) Field of Classification Search

CPC . B60B 33/08; B60B 33/0073; B60B 33/0028; B60B 33/0055; B60B 33/0023; A45B 9/04; A61H 3/06; A61H 3/068; B60P 3/32; Y10T 16/1867; Y10T 16/1873

USPC ..... 16/48, 24, 27, 28, 23, 29, 45, 46; 135/84, 85; 482/68

See application file for complete search history.

(56) References Cited

U.S. PATENT DOCUMENTS

| | | | | | |
|---|---|---|---|---|---|
| 793,612 | A | * | 6/1905 | Self | B60B 33/0002 152/413 |
| 984,855 | A | * | 2/1911 | Schaffnit | F16C 19/18 16/24 |
| 1,160,121 | A | * | 11/1915 | Allen | B60B 33/0028 16/21 |
| 1,448,783 | A | * | 3/1923 | Blewitt | A61H 3/04 482/68 |
| 1,562,124 | A | * | 11/1925 | Rautenberg | A63C 17/22 384/372 |
| 1,791,448 | A | * | 2/1931 | Johnson | B60B 33/0002 16/21 |
| 1,793,827 | A | * | 2/1931 | Pribil | B60B 33/0002 16/21 |
| 1,861,919 | A | * | 6/1932 | Hill | B60B 33/045 16/37 |
| 2,379,426 | A | * | 7/1945 | Edstrom | A61H 3/068 298/3 |

(Continued)

FOREIGN PATENT DOCUMENTS

| | | | |
|---|---|---|---|
| DE | 102004004061 | A1 | 8/2005 |
| GB | 2389784 | A | 12/2003 |

*Primary Examiner* — Noah Chandler Hawk

(74) *Attorney, Agent, or Firm* — Sand, Sebolt & Wernow Co., LPA

(57) ABSTRACT

A bi-axial ball tip for use with a mobility cane. The bi-axial ball tip includes an omni ball, at least two mirrored brackets, and a grip. The mirrored brackets form a chamber to accommodate part of the omni ball, allowing the omni ball to rotate around a horizontal axis inside the chamber. The rotation of the omni ball when the ball engages a ground surface and is provided to aid visually impaired people. The grip connects the mirrored brackets in a manner such that the mirrored brackets and the omni ball, together, rotate around a vertical axis which is orthogonal to the horizontal axis.

8 Claims, 12 Drawing Sheets

(56) References Cited

U.S. PATENT DOCUMENTS

| | | | | |
|---|---|---|---|---|
| 2,445,942 | A * | 7/1948 | Dusinberre | A61H 3/068 135/85 |
| 3,051,097 | A | 8/1962 | Wyman | |
| 3,237,940 | A * | 3/1966 | Johnson | B62B 5/04 188/29 |
| 4,958,651 | A * | 9/1990 | Najm | A61H 3/068 135/65 |
| 5,975,100 | A * | 11/1999 | Sfeir | A45B 3/00 135/66 |
| 7,698,780 | B2 * | 4/2010 | Yan | B60B 33/021 16/35 R |
| 3,210,997 | A1 | 7/2012 | Thomas et al. | |
| 2004/0181907 | A1 * | 9/2004 | Lee | B60B 33/0068 16/240 |
| 2005/0205122 | A1 * | 9/2005 | Bly | A61H 3/04 135/85 |

* cited by examiner

BI-AXIAL BALL TIP FOR USE WITH A MOBILITY CANE

FIELD OF THE INVENTION

The present invention relates to a bi-axial ball tip for use with a mobility cane.

BACKGROUND TO THE INVENTION

Mobility canes are often known as 'white' canes which are compromise equipment for assisting people with vision impairment such as blindness and low vision. According to the classification from Vision Australia, they come in a variety of types that include the following.

Identification canes that are designed to be a visible signal to others that the user is blind or has low vision. This cane does not detect obstacles but can be used to assist with detecting the height of steps, gutters, and down drops.

Support canes used to aid a person's balance and as a means of physical support.

Long canes that enable a person who is blind or has low vision to detect all obstacles and hazards within their path of travel by moving the cane in front of them.

Mobility canes can include a ball tip being a ball shape tip fitted with a sealed precision ball to enable the tip to rotate on the ground when used in a side rolling motion. The user moves the ball in front of them to detect any obstacles. However, this kind of ball tip only rotates around one axis. Whilst perhaps suitable for urban roads or regular paths when a user walks on a rough road or on a field or needs to move along with a variable path, this kind of ball tip is not really suitable and is not efficient or useful to the user.

The object of this invention is to provide a bi-axial ball tip for use with a mobility cane to address the above shortcomings or at least provide a useful alternative.

SUMMARY OF THE INVENTION

In a first aspect the invention comprises a bi-axial ball tip for use with a mobility cane, comprising: an omni ball, at least two mirrored brackets and a grip; the mirrored brackets forming a chamber to partially accommodate the omni ball, allowing the omni ball to rotate around a horizontal axis inside the chamber; the grip connecting the mirrored brackets in a manner that the mirrored brackets and the omni ball together rotate around a vertical axis which is orthogonal to the horizontal axis.

In preference each of the mirrored brackets forms a bearing housing when they are matched together; and the bottom parts of the mirrored brackets with arcuate surfaces form the chamber to accommodate the omni ball rotating inside.

In preference one bolt is screwed from outside through the bottom part of each of the mirrored bracket, a bearing and then mounted on the axle.

In preference a vertical axle is placed within the formed tube.

In preference the vertical axle is inserted into the bearings from the top and a bolt is threaded into the vertical axle from the bottom, placed in the upper parts of the mirrored brackets.

In preference the top of the vertical axle is at the bottom of the grip; and the grip is pressed into the compression bracket base and glued or otherwise attached. The two bearings are located in the mirrored bracket bearing housing and affixed on the tube axle typically with a nylon screw.

In preference the compression bracket has threads on the top; and an olive is placed the top of the grip, and a matching threaded cap top on the top of the olive; the inner side of the bracket top having matching threads to the threads on the grip.

In preference the omni ball is made of a nylon base over moulded polyurethane

It should be noted that any one of the aspects mentioned above may include any of the features of any of the other aspects mentioned above and may include any of the features of any of the embodiments described below as appropriate.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will refer to several drawings as follows.

DETAILED DESCRIPTION OF THE INVENTION

Figure 1A:
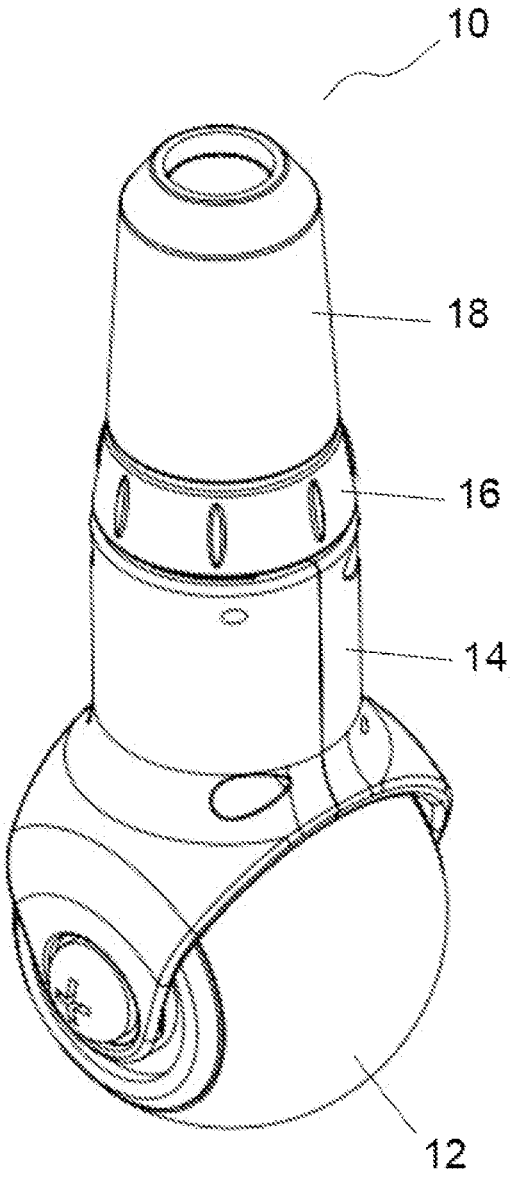
FIG. 1*a* is a three-dimensional view of the ball tip embodying the invention.

The following detailed description of the invention refers to the accompanying drawings. Wherever possible, the same reference numbers will be used throughout the drawings and the following description to refer to the same and like parts. Dimensions of certain parts shown in the drawings may have been modified and/or exaggerated for the purposes of clarity or illustration.

Figure 1B:
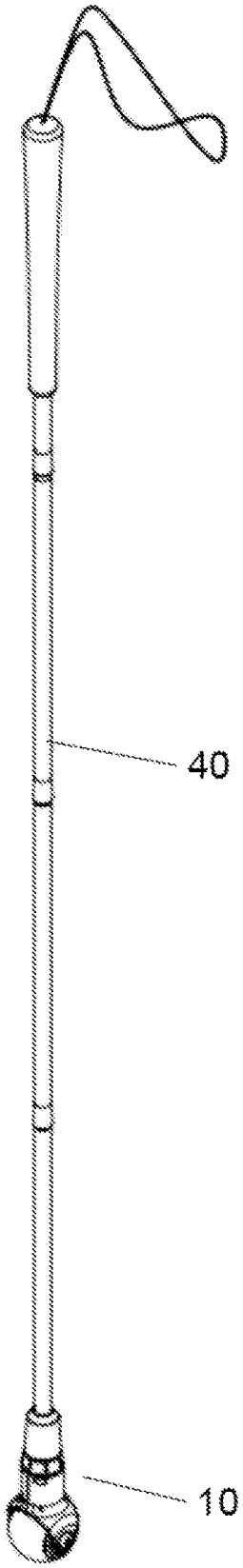
FIG. 1*b* is a three-dimensional view of the mobility cane with the ball tip embodying the invention.
Figure 2A:
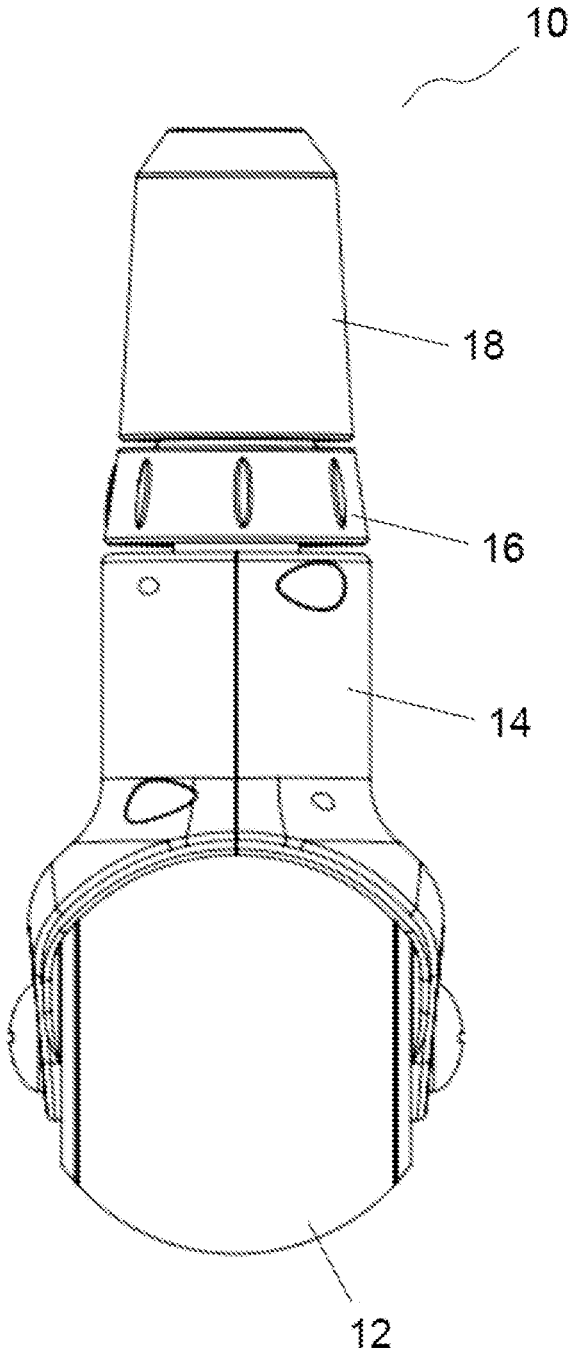
FIG. 2*a* is a front view of the ball tip embodying the invention.
Figure 2B:
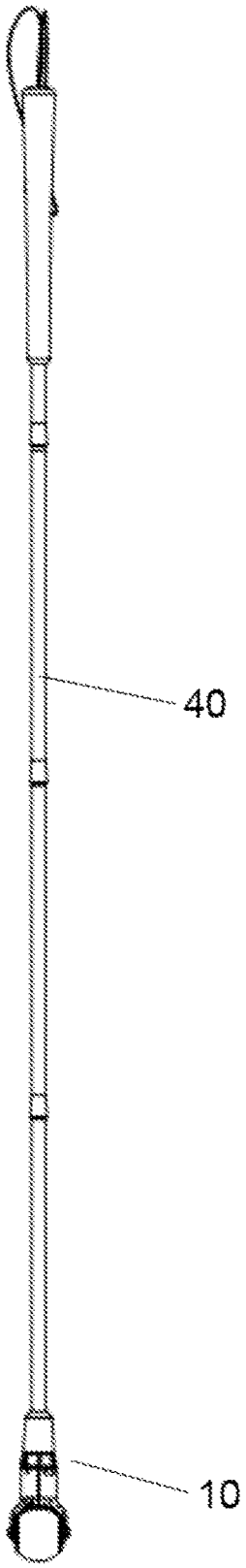
FIG. 2*b* is a front view of the mobility cane with the ball tip embodying the invention.
Figure 3A:
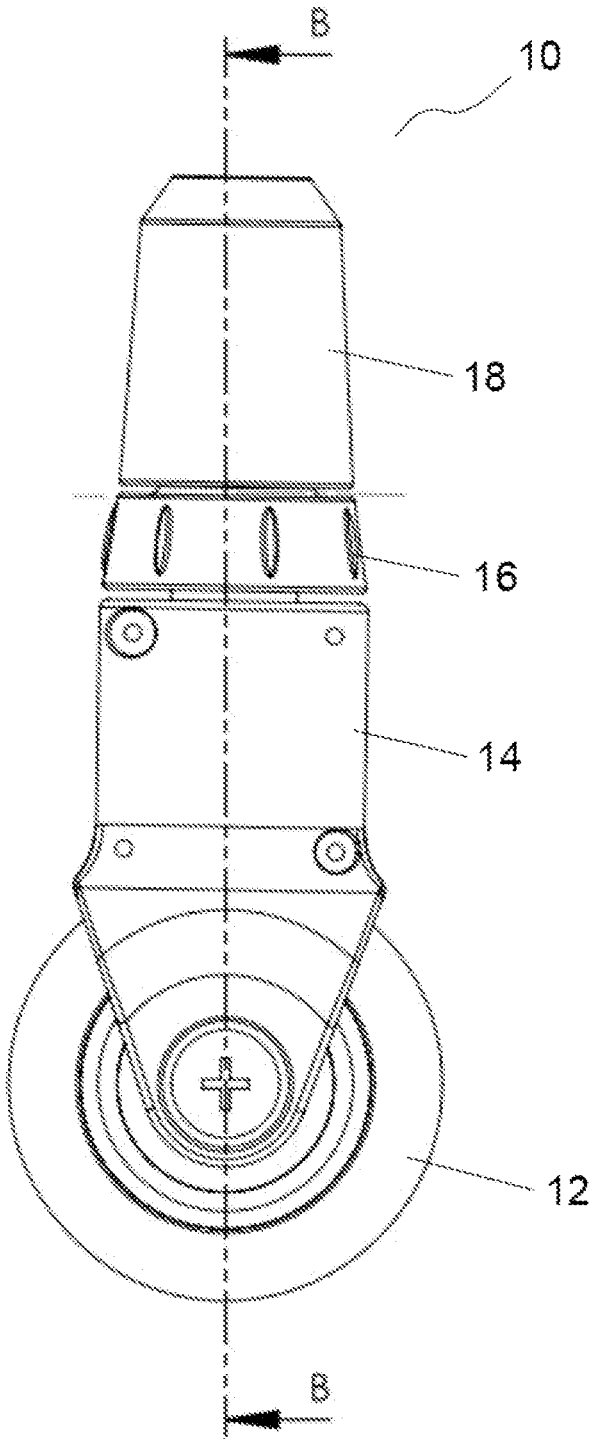
FIG. 3*a* is a side view of the ball tip embodying the invention.
Figure 3B:
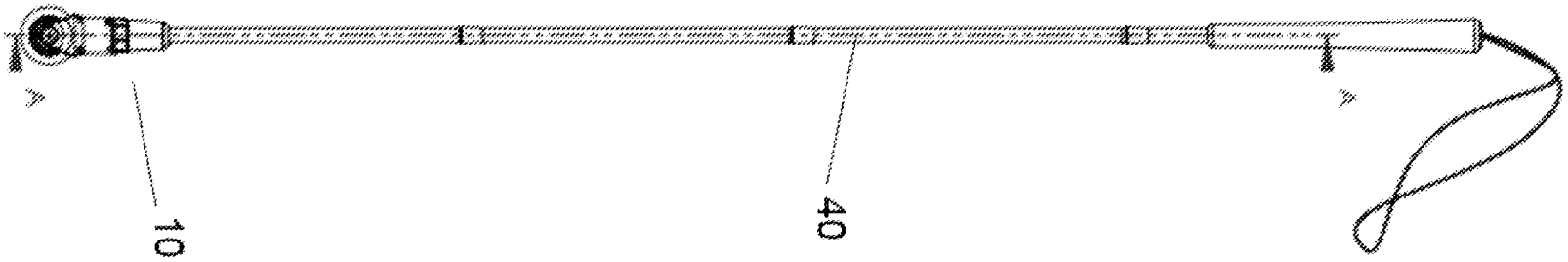
FIG. 3*b* is a side view of the mobility cane with the ball tip embodying the invention.

Referring to FIG. 1*a*, it is a three-dimensional view of the ball tip embodying the invention. It illustrates a bi-axial ball tip 10 for use with a mobility cane. The bi-axial ball tip 10 includes an omni ball 12, mirrored brackets 14 and a grip 16. Preferably, in some embodiments of the present invention, a compression bracket top 18 is on the top of the grip 16 as shown in FIG. 1*a*. FIG. 1*b* shows the mobility cane working with the ball tip of the present invention.

Figure 4A:
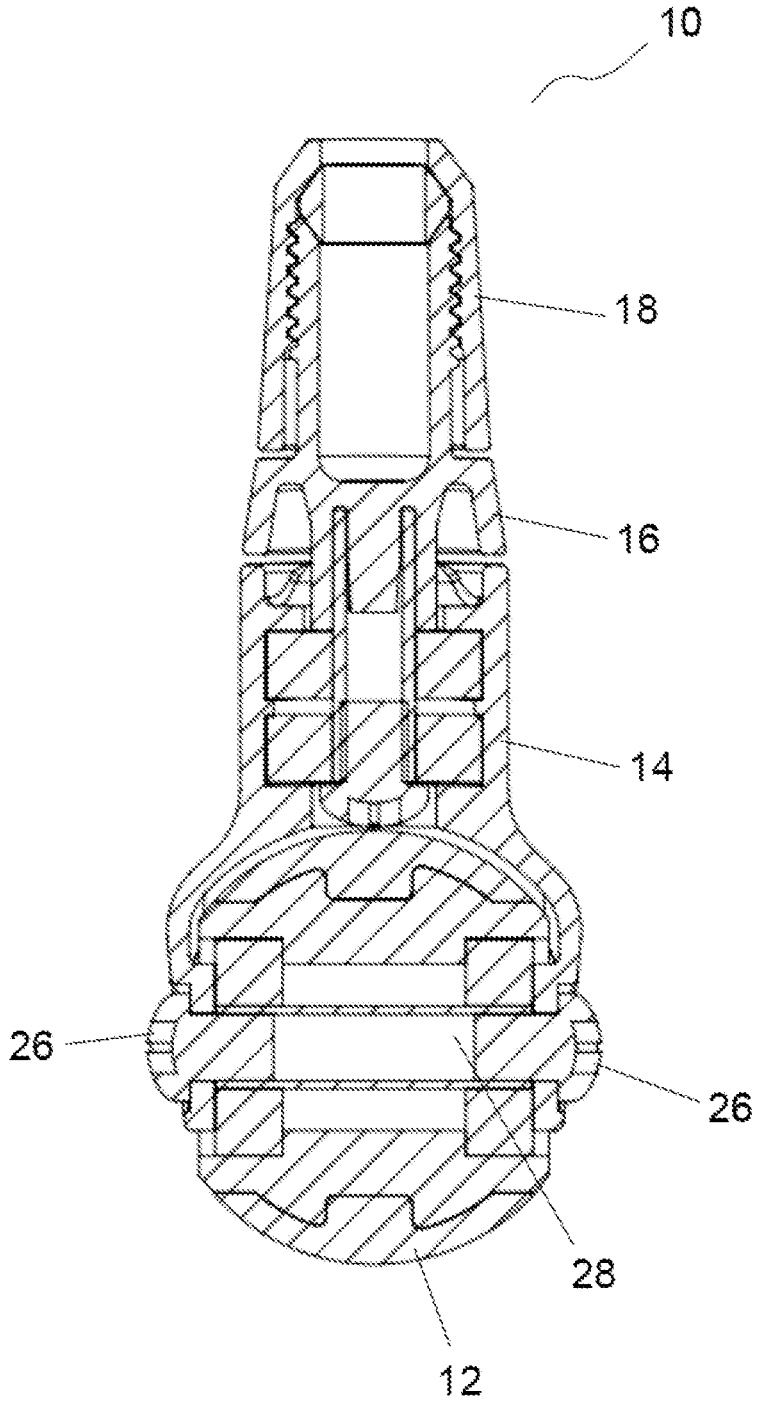
FIG. 4*a* is a front cross-sectional view of the ball tip embodying the invention.
Figure 4B:
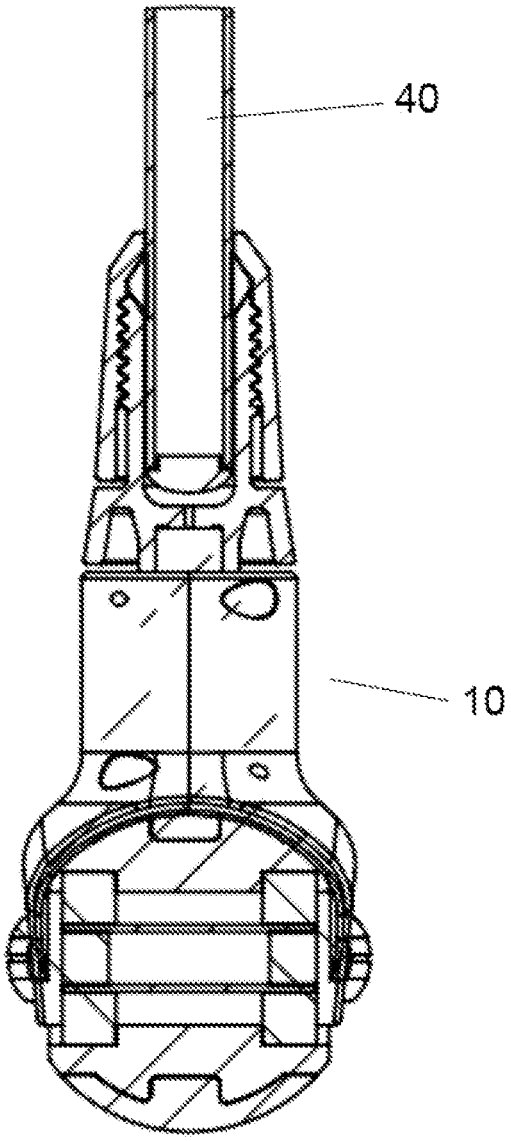
FIG. 4*b* is a front cross-sectional view of the ball tip embodying the invention engaging with a mobility cane stick.
Figure 5:
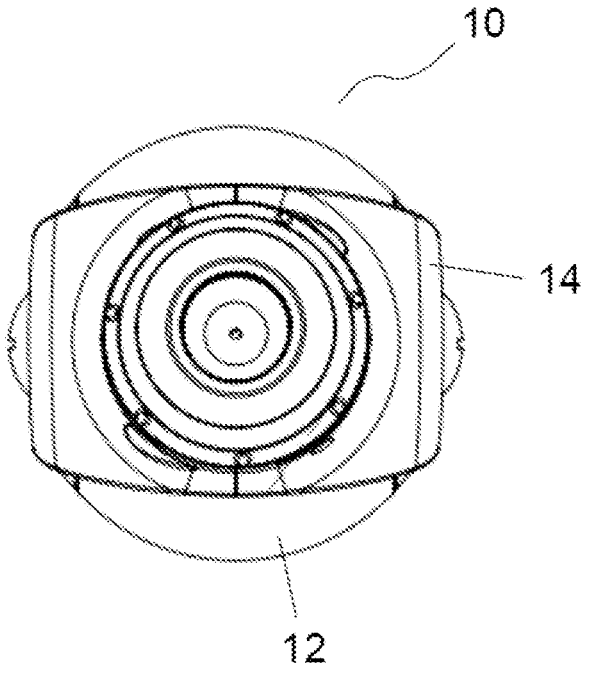
FIG. 5 is a top view of the ball tip embodying the invention.
Figure 6A:
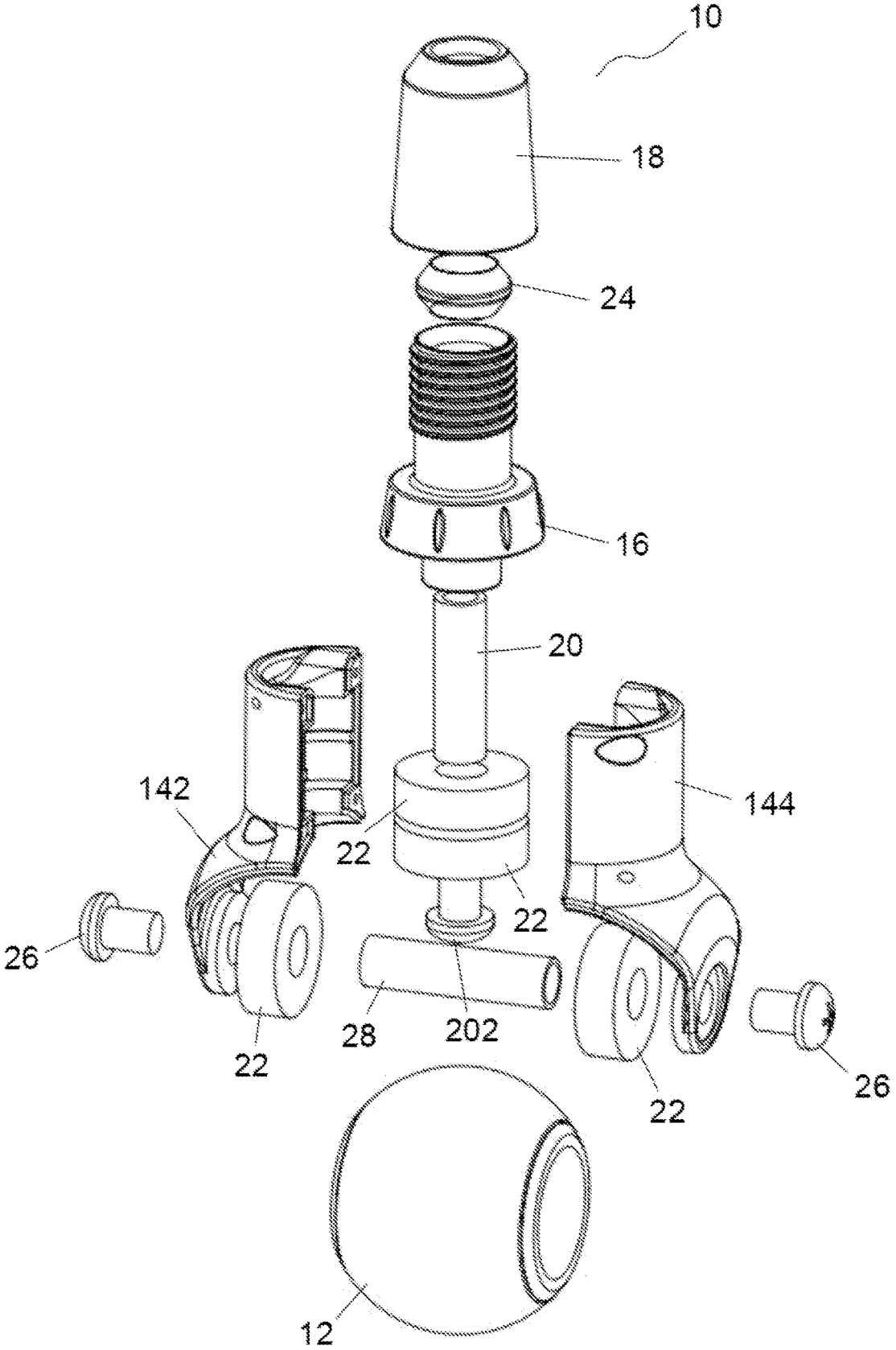
FIG. 6*a* is a three-dimensional exploded view of the ball tip embodying the invention.
Figure 6B:
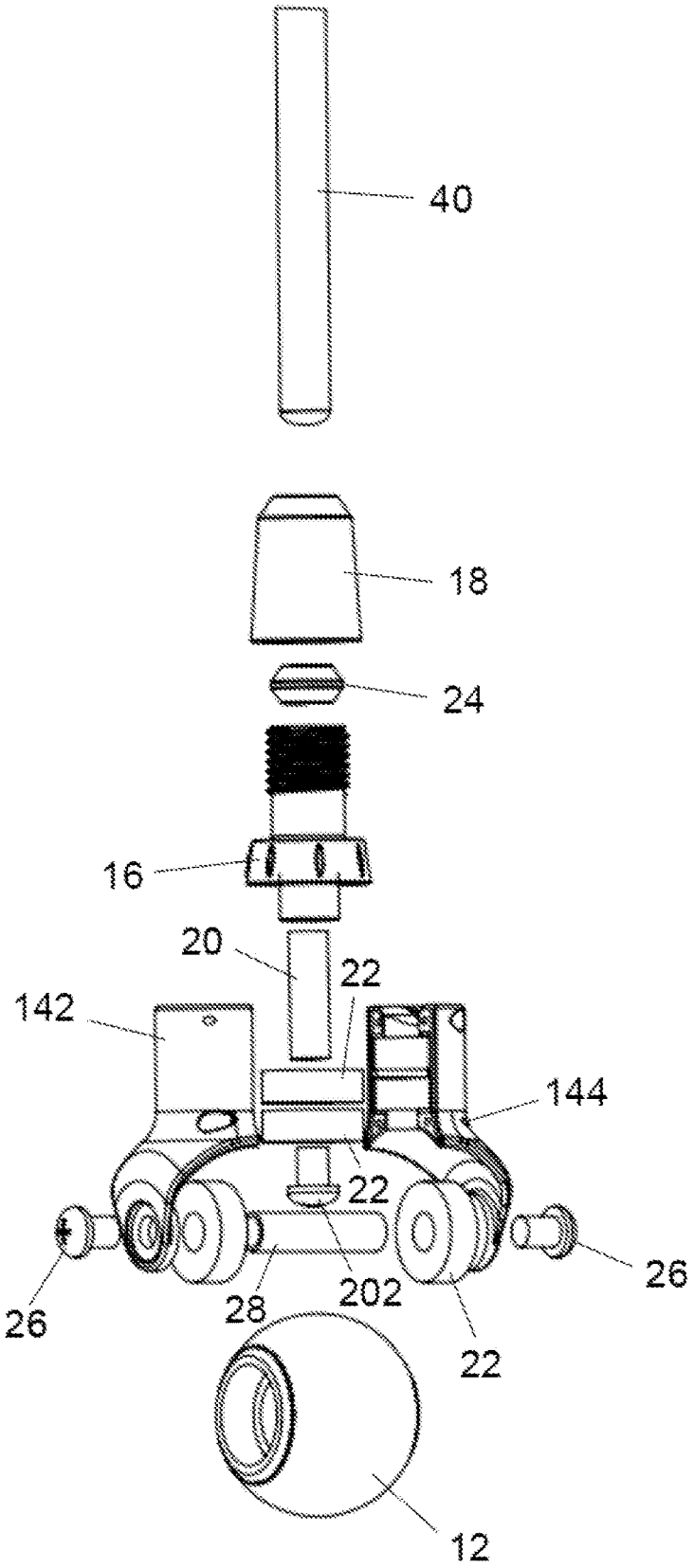
FIG. 6*b* is a three-dimensional exploded view of the ball tip embodying the invention engaging with a mobility cane stick.

Referring to FIGS. 6*a* and 6*b*, the exploded views of the ball tip, the bottom parts of the mirrored brackets 14 accommodate the omni ball 12 partially in the chamber screwing bolts 26 through the holes on the mirrored brackets 14, bearings 22 and then threaded into a tube axle 28 which is placed within the omni ball 12 so that the omni ball 12 is fixed in the chamber by the mirrored brackets 14 as shown in FIGS. 4*a* and 4*b*.

Referring to FIG. 1*a*, the bottom arrow shows the omni ball 12 itself can rotate around a horizontal axis inside the chamber formed by the mirrored brackets 14. Meanwhile, the top arrow shows the mirrored brackets 14 and the omni ball 12 together can rotate around a vertical axis which is orthogonal to the horizontal axis.

Referring to FIGS. 4*a* and 4*b*, in some embodiments, the horizontal axis is defined by the tube axle 28 or the two central points of heads of the bolts 26. The vertical axis is defined along a mobility cane stick 40. As a result, the bi-axial ball tip 10 can rotate around to rotate in any direction without being lifted off the ground. It enables better contact with the surface and reduces catching and bending of the cane tip and cane.

FIG. 6*a* is the three-dimensional schematic exploded view of the ball tip embodying the invention. As shown in FIG. 4*a*, a bi-axial ball tip 10 for use with a mobility cane includes an omni ball 12, two mirrored brackets 14 which are a left bracket 142 and a right bracket 144, a grip 16, a bracket top 18 and inside components, which comprise a vertical axle 20, bearings 22, an olive 24, bolts 202, 26, and tube axle 28. The specific connection of those components will now be described in more detail.

As shown in FIG. 6*a*, the mirrored brackets 14 are split away along the horizontal axis in the exploded view. Each of the mirrored brackets 14 has two parts. The upper parts of the mirrored brackets 14 have arcuate surfaces, which form a tube when they are matched together. Within the formed tube, the vertical axle 20 is inserted into the holes in the bearings 22 from the top and the bolt 202 is threaded into the vertical axle 20 from the bottom. In a preferred embodiment, the diameter of the head of the bolt 202 is bigger than the hole in the bearing 22 so that the vertical axle 20 is fixed in the place.

The bottom parts of the mirrored brackets 14, including the left bracket 142 and the right bracket 144, also have arcuate surfaces which form a chamber accommodate the omni ball 12 rotating inside. One bolt 26 is screwed from outside through the bottom part of the left mirrored bracket 142 or the right mirrored bracket 144 and a bearing 22, which in a preferred embodiment is made of nylon, then threaded into the tube axle 28. The omni ball 12 is therefore included in the chamber formed by the mirrored brackets 14. As a result, mirrored brackets 14 form an integrity unit with the tube on the top and the chamber on the bottom when they are clamped together as shown in FIGS. 1*a*, 2*a*,-3*a*, 4*a* and 5. The bolt 26 in a preferred embodiment is a 24 mm M8 Nylon Phillips head screw.

Referring to FIG. 6*a*, the top of the axle 20 is at the bottom of the grip 16. In a preferred embodiment, the ergonomic grip 16 is twisted and fastened to the inner thread of the mirrored brackets 14 when they are screwed together as an integrity unit as shown in FIGS. 1*a*, 2*a*, 3*a*, 4*a* and 5.

In another preferred embodiment, the tube axle 28 and the vertical axle 20 are made of aluminium with inner threads which are matched with the threads on the bolts 202 and 26. It should be noted that the inner threads or threads on the bolts are not shown in the Figures which does not affect the protection scope of the present invention.

In another preferred embodiment, the grip 16 has and injection moulded thread section on the top as shown in FIG. 6*a*. A nylon universal compression olive 24 is placed between the grip 16 and the bracket top 18, the inner side of which has matching threads to the threads on the grip 16. The bi-axial ball tip 10 is attached to a mobility cane stick 40 by simply inserting the mobility cane stick 40 into the top hole of the bracket top 18 as shown in FIGS. 4*b* and 6*b*. The mobility cane stick 40 is changeable for different purposes or different users.

The bi-axial ball tip 10 provided by the present invention may be used at a natural angle from the user's hand to the ground. It should be noted that, in an embodiment of the present invention, the bi-axial ball tip 10 can be inclined to the ground, between 0-60 or 90-30 degrees.

Figure 7:
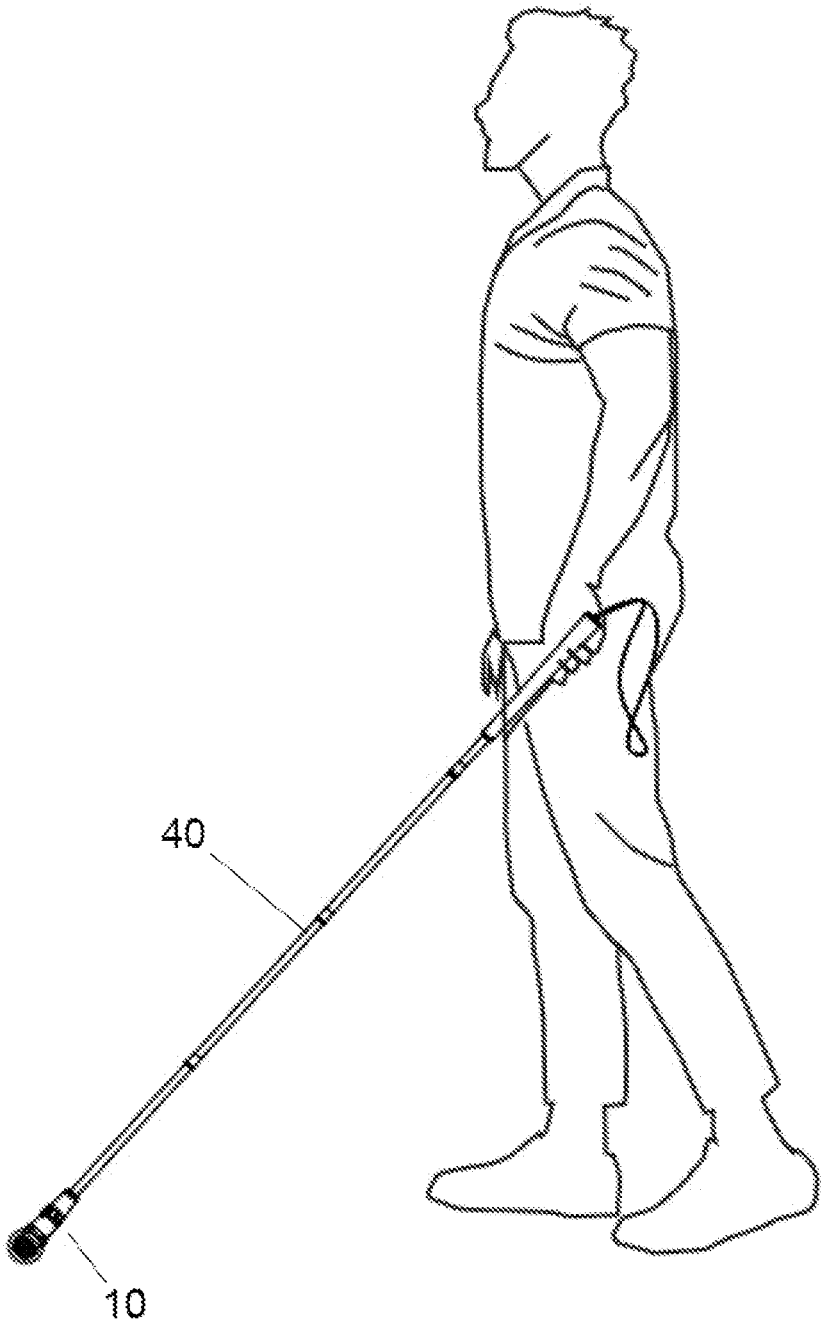
FIG. 7 is a schematic view of the mobility cane with the ball tip in use according to a preferred embodiment of present invention.

When the described components are assembled, the omni ball 12 itself can roll on the ground around a horizontal axis, which is controlled by and can move laterally to the motion of the user. Meanwhile the omni ball 12 and the mirrored brackets 14 together can also rotate around a vertical axis that is orthogonal to the horizontal axis, which is also controlled by enables the user to change directions or turn around. As a result, the bi-axial ball tip 10 can move around, at the same time, rotate forwards or backwards in any direction without being lifted off of the ground, but just moving on the ground, as shown in FIG. 7, being a schematic view of the bi-axial ball tip 10 in use. It assists people with vision impairment for variable tracking paths. It creates more flexibility and consequently makes it easier to use.

Moreover, an important feature of the present invention that by rotating on the ground instead of dragging across it, the present invention provides a low wear and long-life ball tip use for mobility canes.

It should be also noted that the bi-axial ball tip provided by the present invention is adaptable to fit most existing mobility canes.

The reader will now appreciate the present invention which provides a bi-axial ball tip for use with a mobility cane which is easier to use than present solutions and that results in less wear and tear on the ball tip.

LIST OF COMPONENTS

The drawings include the following integers.

10 a cane tip
12 an omni ball
14 mirrored brackets
142 left bracket
144 right bracket
16 grip
18 bracket top
20 vertical axle
202 a bolt 202
22 bearings
24 olive
26 bolts
28 tube axle
40 cane stick Further advantages and improvements may very well be made to the present invention without deviating from its scope. Although the invention has been shown and described in what is conceived to be the most practical and preferred embodiment, it is recognized that departures may be made therefrom within the scope of the invention, which is not to be limited to the details disclosed herein but is to be accorded the full scope of the claims so as to embrace any and all equivalent devices and apparatus. Any discussion of the prior art throughout the specification should in no way be considered as an admission that such prior art is widely known or forms part of the common general knowledge in this field.

In the present specification and claims (if any), the word "comprising" and its derivatives including "comprises" and "comprise" include each of the stated integers but does not exclude the inclusion of one or more further integers.

The invention claimed is:

1. A mobility cane comprising:

a mobility cane stick adapted to be held at an inclined angle relative to the ground by a user; and a bi-axial ball tip engaged with the mobility cane stick, said bi-axial ball tip comprising:

an omni ball having a ground-contacting exterior surface which is generally spherical in configuration;

at least two mirrored brackets; and a grip;

wherein each of the mirrored brackets has an upper part and a bottom part;

wherein when the upper parts of the mirrored brackets are matched together, they form a tube;

wherein a vertical axle is placed in the upper parts of the mirrored brackets within the formed tube;

wherein the vertical axle is inserted into an aperture defined in a top of a bearing and a bolt is threaded through the aperture defined in the bearing and into a bottom of the vertical axle;

wherein the bottom parts of the mirrored brackets have arcuate surfaces which form a chamber to accommodate part of the omni ball rotating inside, allowing the omni ball to roll across the ground while rotating around a horizontal axis inside the chamber; and wherein the grip connects the mirrored brackets in a manner that the mirrored brackets and the omni ball together rotate around a vertical axis which is orthogonal to the horizontal axis; and wherein the mobility cane is movable in a lateral direction relative to a motion of the user while the omni ball is in contact with the ground.

2. The mobility cane of claim 1, wherein a bolt is screwed from outside through the bottom part of each of the mirrored brackets, is threaded through a bearing; and then threaded into a tube axle.

3. The mobility cane of claim 1, wherein the mobility cane stick has a first end and a second end; wherein the bi-axial ball tip is provided at the second end of the mobility cane stick, and wherein the omni-ball is aligned with the mobility cane stick.

4. The mobility cane of claim 3, wherein the vertical axis about which the bi-axial tip rotates extends along a shaft of the mobility cane stick.

5. The mobility cane of claim 4, wherein the horizontal axis is defined by a tube axle or two central points of heads of fasteners which secure the biaxial ball tip to the mobility cane stick.

6. The mobility cane of claim 1, wherein, during use, the bi-axial ball tip is able to rotate about the horizontal axis and the vertical axis without being lifted off the ground.

7. A mobility cane comprising:

a mobility cane stick adapted to be held at an inclined angle relative to the ground by a user; and a bi-axial ball tip engaged with the mobility cane stick, said bi-axial ball tip comprising:

an omni ball having a ground-contacting exterior surface which is generally spherical in configuration;

at least two mirrored brackets; and a grip;

wherein the mirrored brackets form a chamber to accommodate part of the omni ball, allowing the omni ball to roll across the ground while rotating around a horizontal axis inside the chamber;

wherein the grip connects the mirrored brackets in a manner that the mirrored brackets and the omni ball together rotate around a vertical axis which is orthogonal to the horizontal axis;

wherein the mobility cane is movable in a lateral direction relative to a motion of the user while the omni ball is in contact with the ground; and wherein the vertical axis about which the bi-axial tip rotates passes through the horizontal axis about which the omni ball rotates.

8. A mobility cane comprising:

a mobility cane stick adapted to be held at an inclined angle relative to the ground by a user; and a bi-axial ball tip engaged with the mobility cane stick, said bi-axial ball tip comprising:

an omni ball having a ground-contacting exterior surface which is generally spherical in configuration;

at least two mirrored brackets; and a grip;

wherein the mirrored brackets form a chamber to accommodate part of the omni ball, allowing the omni ball to roll across the ground while rotating around a horizontal axis inside the chamber;

wherein the grip connects the mirrored brackets in a manner that the mirrored brackets and the omni ball together rotate around a vertical axis which is orthogonal to the horizontal axis;

wherein the mobility cane is movable in a lateral direction relative to a motion of the user while the omni ball is in contact with the ground; and a compression bracket threadedly engaged with the grip of the bi-axial ball tip, wherein the compression bracket connects the mobility cane stick and the bi-axial ball tip to one another.

* * * * *